US006634144B1

(12) United States Patent
Moore et al.

(10) Patent No.: US 6,634,144 B1
(45) Date of Patent: Oct. 21, 2003

(54) HOME WATERPROOFING SYSTEM

(75) Inventors: Carl Moore, Summit City, OH (US); Nick DiCello, Summit City, OH (US)

(73) Assignee: Everdry Marketing & Management Services, Inc., Macedonia, OH (US)

( * ) Notice: Subject to any disclaimer, the term of this patent is extended or adjusted under 35 U.S.C. 154(b) by 10 days.

(21) Appl. No.: 10/002,450

(22) Filed: Nov. 2, 2001

(51) Int. Cl.[7] ..... E02D 19/00

(52) U.S. Cl. ..... 52/169.5; 52/169.14; 52/741.13; 405/38

(58) Field of Search ..... 52/169.5, 169.14, 52/741.41, 741.13, 302.3; 405/43, 38, 50

(56) References Cited

U.S. PATENT DOCUMENTS

| | | | | | |
|---|---|---|---|---|---|
| 2,146,775 | A | * | 2/1939 | Stoutenburgh | 52/169.5 |
| 3,850,193 | A | | 11/1974 | Guzzo | |
| 4,538,386 | A | * | 9/1985 | DiCello | 52/169.5 |
| 4,773,195 | A | | 9/1988 | Waller | |
| 4,869,032 | A | | 9/1989 | Geske | |
| 5,316,410 | A | | 5/1994 | Blume | |
| 5,399,050 | A | | 3/1995 | Jacobus | |
| 5,495,696 | A | | 3/1996 | Repka | |
| 5,740,638 | A | | 4/1998 | Shepherd, III | |
| 5,836,115 | A | * | 11/1998 | Clay et al. | 52/169.5 |
| 5,845,456 | A | * | 12/1998 | Read | 52/741.11 |
| 6,224,700 | B1 | * | 5/2001 | Oakley | 156/71 |

* cited by examiner

*Primary Examiner*—Carl D. Friedman
*Assistant Examiner*—Naoko Slack
(74) *Attorney, Agent, or Firm*—Fay, Sharpe, Fagan, Minnich & McKee, LLP

(57) ABSTRACT

A waterproof system for draining water away from a building located in ground having a surface above which a portion of the building extends. The building has a footer and at least one wall extending vertically from the footer. The system includes a first drain member located in a first trench provided in the ground outside the building. A membrane including a first portion and a second portion is provided. The first portion forms a liner which lines the first trench to form a trough for capturing water. The second portion is affixed to an outer surface of the wall along at least a portion of a height of said wall and extending toward the footer.

31 Claims, 3 Drawing Sheets

HOME WATERPROOFING SYSTEM

BACKGROUND OF THE INVENTION

The present invention relates to a system and method for preventing water from seeping into a building, and in particular relates to a waterproofing system for a house.

The seepage of water into a building has been a problem which constantly plagues the construction industry. This has been a problem for buildings which have basements as well as buildings built on a slab. In particular, the seepage problem has plagued buildings having a below-ground foundation wall.

It is known that the foundation wall of a building is most often made from hollow concrete blocks or poured concrete. With blocks, water is able to pass from the exterior surrounding ground of the building through cracks, holes, natural pores, etc. in the block into hollow cavities of the block and thence to the basement floor. Even if the foundation wall is made from solid blocks or poured concrete, water may seep into the basement through cracks and by capillary action.

Numerous drainage systems and methods have been developed. In one known system, drain tiles having holes therein for receiving water are located around the outside perimeter of a building, namely, around the outside perimeter of the basement floor and in a deep trench at or below the level of the footer. The drain tiles form a pipe line which directs water to a storm or sanitary sewer. After a period of time, the drain tiles become non-functioning due to collapsing, blockage, separation, etc., and water accumulates at the bottom of the foundation wall, with a resultant build-up of hydrostatic pressure. This water then seeps through cracks, holes, pores, etc. in the foundation wall and into the basement. To correct this problem, the drain tile must be replaced. However, replacement of a non-functioning tile is a very cumbersome operation which requires digging a trench along the foundation wall. This is not only troublesome, it can cause shifting of the building and structural damage. Further, digging a trench requires a backhoe, operation of which would damage the adjacent lawn, etc. This is an extremely costly operation. Also, such drain tiles located outside the perimeter of the basement do not effectively handle water buildup beneath the basement floor.

Another system includes a trench formed along the inside of a foundation wall next to the footer and beneath the basement floor or the like. Perforated drain tiles are placed in the trench and form a pipe line which directs water to a storm or sanitary sewer. The drain tiles are surrounded by gravel. Drainage openings are provided in the bottom portion of the foundation wall beneath the basement floor. The water flows through these openings into the gravel and to the drain tile from which the water flows into a sewer. Such a system relies on the water to drain downwardly through the concrete blocks. If the blocks have cracks in the interior of the foundation wall, the water will seep through such cracks. Thus, this system is not particularly effective.

It would be desirable to provide a system which minimizes the above-identified problems in the prior art and handles water buildup beneath the building, eliminates hydrostatic pressure under the floor of the building, completely seals the exterior foundation walls, removes any hydrostatic pressure that accumulates at the outside base of the foundation, and directs water and moisture away from the foundation.

Accordingly, it is desirable to develop a new and improved home waterproofing system which would overcome the foregoing deficiencies and others while meeting the above-stated needs and providing better and more advantageous overall results.

SUMMARY OF THE INVENTION

The present invention relates to a new and improved home waterproofing system. More specifically, the home waterproofing system is used to minimize seepage of water and moisture into a home.

The present invention may also be applied to different types of building structures, for example, ones having a below-ground poured concrete foundation, a below-ground concrete block foundation, or even those built on a slab. The system of the present invention is extremely effective in minimizing seepage of water into a building.

More particularly, in one embodiment, the present invention comprises a waterproofing system for draining water away from a building located in ground having a surface above which a portion of the building extends, the building having a footer and at least one wall extending vertically from the footer. The system comprises a first drain member located in a first trench provided in the ground outside the building. The first drain member extends adjacent at least a portion of the wall. A membrane comprises a first portion and a second portion. The first portion, which is secured to the second portion, forms a liner which lines at least a portion of the first trench to form a trough for capturing water flowing from the ground surface into the trench and for preventing water from flowing downwardly along the wall. The second portion is positioned adjacent to an outer surface of the wall along at least a portion of a height of the wall and extends toward the footer. The first portion of the membrane is thinner than the second portion and extends from the second portion at a location below an upper edge of the second portion. The membrane comprises a rubber material. A dampproofing coating can be positioned between the wall and the membrane second portion.

A base is located within the building. A second drain member is located in a second trench provided in the ground beneath the base adjacent a perimeter thereof. The second trench extends along at least a portion of the base and adjacent an inner surface of the wall. The first and second drain members each comprises a pipe for receiving water captured in the trenches and for conducting water away from the building. The first and second trenches comprise gravel filling which covers the first and second drain members. A liner is affixed to the inner surface of the wall and extends to the top surface of the footer. The second trench engages a portion of the liner.

A second embodiment of the present invention includes the membrane second portion extending to the footer, and a filler block which is positioned adjacent a seam formed between a top surface of the footer and a bottom surface of the wall. The filler block includes an angled surface to drain water away from the seam. If desired, one of the first portion and the second portion of the membrane is draped over the filler block.

A third drain member is located in a third trench provided in the ground beneath the base adjacent the perimeter thereof. The third trench extends along at least a portion of the base and is adjacent the outer surface of the wall. The third drain member also comprises a pipe for receiving water captured in the third trench and for conducting water away from the building.

A third embodiment of the present invention is used with existing or new slab foundations. A membrane extends to a footer and a filler block and is positioned adjacent a seam formed between a top surface of the footer and a bottom surface of the wall. The membrane is draped over the filler block and seals the footer. A drain member is located in a trench provided in the ground adjacent the perimeter of the footer. The trench extends along at least a portion of the footer and is adjacent an outer surface of the wall. The drain member has a pipe for receiving water captured in the trench and for conducting water away from the slab.

Still other aspects of the invention will become apparent to those skilled in the art upon reading and understanding the following detailed description.

BRIEF DESCRIPTION OF THE DRAWINGS

The invention may take form in certain components and structures, preferred embodiments of which will be illustrated in the accompanying drawings wherein.

DETAILED DESCRIPTION OF THE EMBODIMENTS

Figure 1:
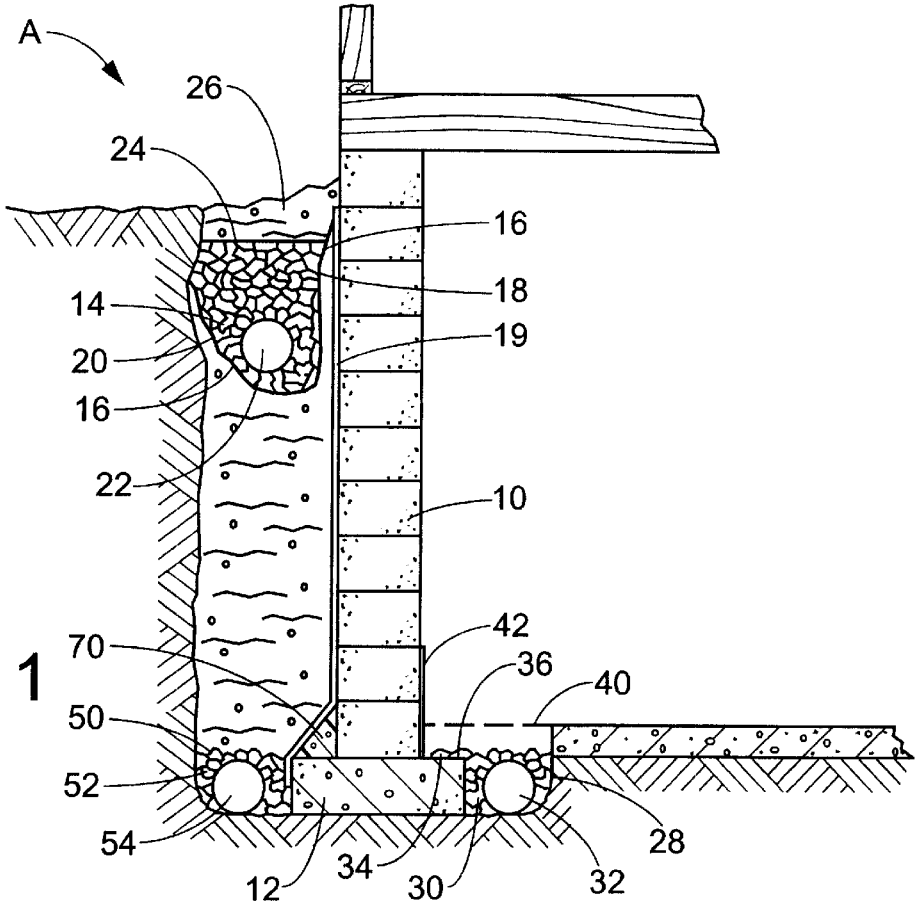
FIG. 1 is a schematic cross-sectional view of a building having a below-grade foundation wall with a waterproofing system according to a first embodiment of the present invention applied thereto.

Referring now to the drawings, wherein the showings are for purposes of illustrating preferred embodiments of the invention only and not for purposes of limiting same, FIG. 1 shows a home waterproofing system A according to one embodiment of the present invention. This system is used with new construction buildings or homes. The waterproofing system A is used with a foundation wall 10 which is supported on a footer 12. A first, outside trench 14 is excavated to a shallow depth beneath the ground level next to the outside surface of the wall 10. Preferably, the trench is not less than 18 inches deep, not less than 14 inches wide, and not greater than about three feet deep.

The trench 14 is dug at an angle to the horizontal to provide for flow of water in the tile. Thus, cumbersome deep excavation is unnecessary. The trench may be dug manually and it is unnecessary for a workman to work in a deep, narrow trench.

On the outside surface of the wall 10, a waterproofing sealing membrane 16 is affixed to seal the wall. The membrane 16 is preferably constructed from a thick, rubberized material.

Figure 2:
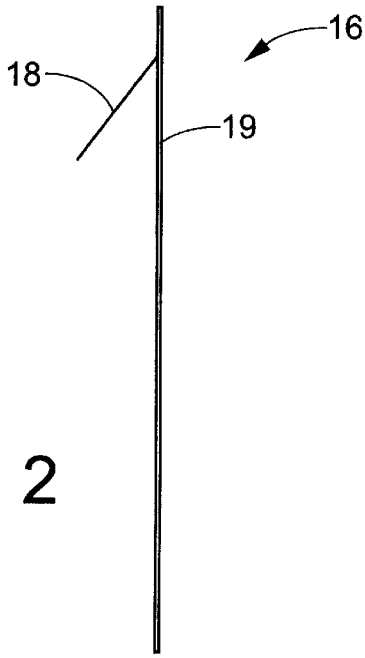
FIG. 2 is a side elevational view of a waterproofing membrane of the waterproofing system of FIG. 1.

The membrane includes a first portion 18 and a second portion 19 (see FIG. 2). The first portion is a solid, thin membrane, which can be 48 inches long. The first portion is secured to and extends from the second portion approximately 12 inches from the top of the second portion. The second portion is thicker than the first portion, and has a height of either six feet for a five foot grade, or seven feet for a six foot grade. The membrane is typically provided as rolls of 50 feet width to minimize the number of seams running between the membranes. The first portion 18 of the membrane is placed in the trench 14 to form a trough. A layer of gravel 20 is placed in the trough. The gravel is preferably a washed river bed gravel size #57. The membrane second portion 19 has an upper edge extending from adjacent the ground surface to a lower edge draped over the footer 12. The membrane second portion 19 also can have a width which covers a width of the wall 10. If desired, the membrane second portion 19 can have a width which also covers the width of other walls of the building adjacent wall 10.

The membrane second portion 19 is applied to an outer surface of the wall 10 as follows. A light coating of a conventional dampproofing (not shown) is sprayed onto the outer wall surface. The membrane second portion 19 is then placed onto the still wet dampproofing. The membrane is then fastened or buttoned to the wall at the top of the membrane via expandable concrete nails (not shown). The nails are standard metal nails which have a plastic collar that expands like a wingnut into the concrete. Such nails are commercially available from International Tool Works (ITW) located in Glenview, Ill.

A drain tile 22 for draining water is then placed in the trough. The drain tile may take a variety of forms, for example, the drain tile may be corrugated perforated flexible pipe, plastic perforated pipe sections, etc. If pipe sections are used, the individual pipe sections or drain tiles 22 are placed in the trough and secured together by a suitable adhesive to form a pipe line.

After the drain tile 22 is placed in the trough, the trough is filled with additional gravel 20 to cover the tile. The gravel size is large enough that it does not clog the openings in the drain tile. The gravel protects the tile from dirt and allows water to flow therethrough to the tile. The gravel 20 may be covered by a perforated plastic sheet 24 which can have 18 holes per square foot, and the trench may be back filled with a backfill 26 of earth. Because of the perforated plastic sheet and gravel, dirt is not readily able to penetrate and clog the drain tile. Also, this arrangement blocks water from contact with the building base such as a slab or a foundation wall.

A second, inside trench 28 is formed adjacent an inside surface of the wall 10 next to the footer 12. A gravel bed 30 is laid and drain tile 32 is placed in the inside trench 28. These tiles, if individual pipe sections, are secured together by a suitable adhesive to form a pipe line. The respective pipe lines formed by the drain tiles 22 and 32 are inclined to the horizontal to provide for free flow of water through the lines.

The drain tiles 32 are also covered with gravel 30. The gravel 30 fills the trench 28 and forms a layer on a portion 34 of a top surface 36 of the footer 12 which is located inside the foundation wall 10. The top layer of the gravel can be covered with cement forming a basement floor or base 40.

A liner 42 is mounted between the wall 10 and the footer 12. The liner 42 extends upwardly from the top surface of the footer 12 to slightly above a top surface of the base 40.

The walls 10, especially if they are foundation walls (conventionally made from hollow blocks), may have openings or weep holes at the bottom thereof to facilitate water flow to the inside drain tiles. The water flows through the openings to the drain tiles and therefrom to a storm sewer system. The liner 42 may have notches for conducting water which flows through weep holes in the bottom of the wall 10 into the gravel. The liner may prevent seepage of water between the wall 10 and the base. The liner may also serve as a conduit for conducting water from the openings in the wall to the inside tiles. The liner also keeps weep holes in the wall free of gravel or concrete that could block them.

A third trench 50 can be formed on the outside of the wall 10 adjacent footer 12. A gravel bed 52 is laid and drain tile 54 is placed in the trench. The tile 54 is covered with gravel 52.

Figure 3:
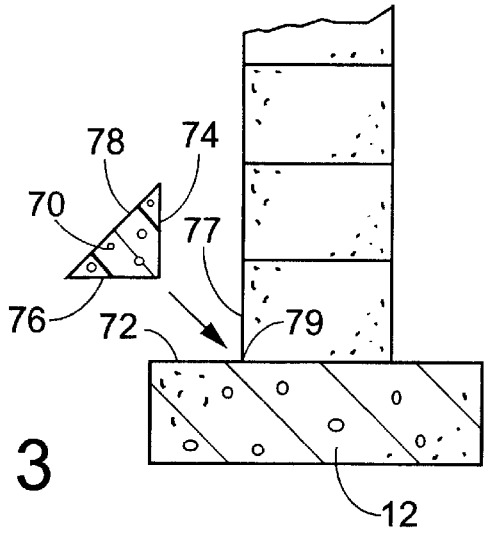
FIG. 3 is an enlarged exploded schematic cross sectional view of a filler block and adjacent building portions of the waterproofing system of FIG. 1.

Referring to FIGS. 1 and 3, a filler or spacer block 70 is positioned on a top surface 72 of the footer 12. The filler is preferably made of Styrofoam or a tar-based product, and is about 6 inches wide and 6 inches high. Other sizes to fit smaller or thinner footers can also be used. The filler 70 can be triangular in shape so that it has first and second sides 74, 76 which are approximately normal to each other and a third side 78 which connects the sides 74, 76. The filler block is placed on the top surface 72 of the footer 12 so that first and second sides 74, 76 are adjacent to a seam 79 formed between the top surface of the footer and a bottom surface 77 of wall 10. The membrane 16 is adhered to wall 10 and also is placed or draped over side 78 of the filler block. Thus, as water or moisture runs down the wall 10, it will be directed away from the footer by angled side 78 of the filler block and toward the third trench 50. If the water or moisture seeps underneath footer 12 toward the basement, the second trench 28 drains the water away from the basement floor.

The drainage system of FIG. 1 operates as follows. Surface water outside the building flow into the first trench 14, the gravel 20, and through openings in the drain tile 22. This water flows through the drain tile into the storm sewer system. The tiles 22 located in the shallow trench outside the building provide for drainage of almost all surface water. Some water or moisture may form on the outside of the wall 10 and may flow down the wall. Membrane second portion 19 seals the wall and prevents the moisture from entering the wall. The water flows down to the filler block 70 which directs the water away from the wall toward the third trench 50 and the drain tile 54. Again, the water flows into the gravel and through openings in the drain tile. Additionally, a small amount of water may build up from beneath the building base. This water flows into the drain tile 32 located beneath the base in the second trench 28. This water flows through the drain tile and is pumped by a sump pump into the storm sewer system. The system according to the present invention minimizes hydrostatic pressure underneath the concrete base 40 of the house, completely seals the outside surface of the wall 10, and minimizes any hydrostatic pressure that may accumulate at the outside of the base of the foundation.

Figure 4:
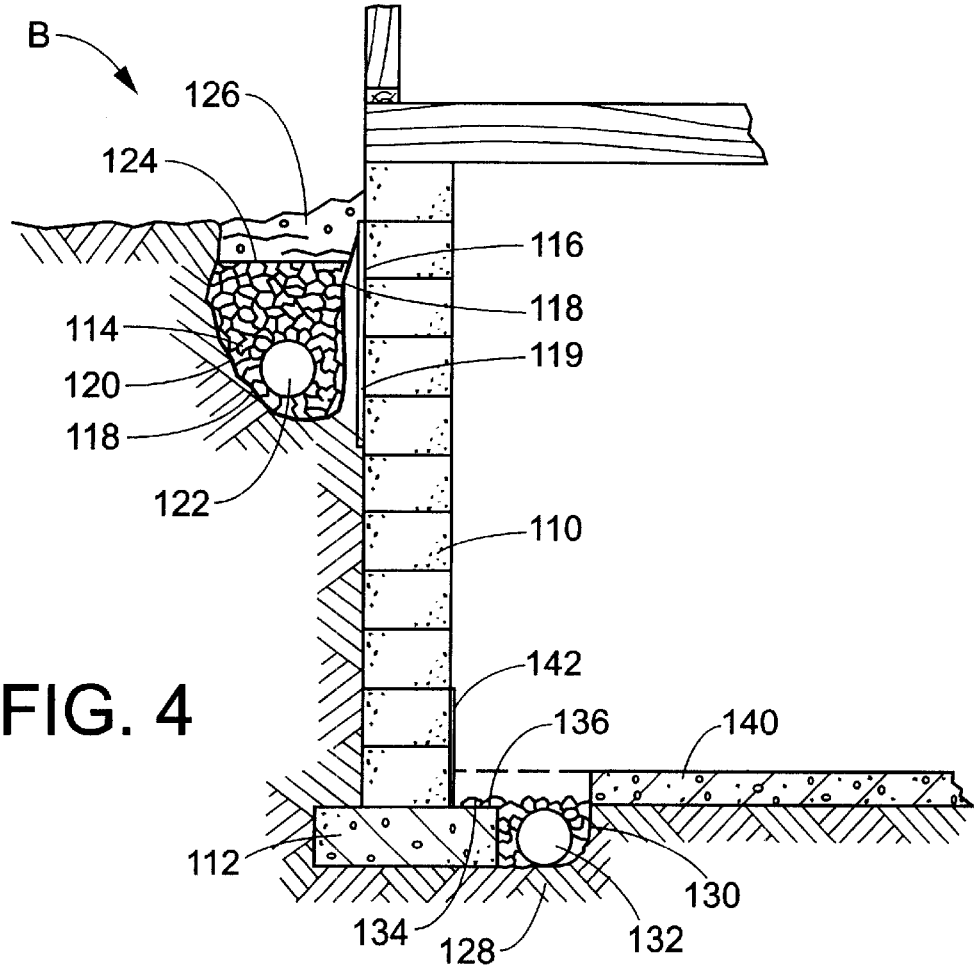
FIG. 4 is a schematic cross-sectional view of a portion of a building have a below-grade foundation with a retrofit waterproofing system in accordance with a second embodiment of the present invention.

A second embodiment is illustrated in FIG. 4. This waterproofing system B is designed as a retrofit for existing buildings.

The waterproofing system B is used with a foundation wall 110 which is supported on a footer 112. A first, outside trench 114 is excavated to a shallow depth beneath the ground level next to the outside surface of the wall 110. Preferably, the trench is not less than 18 inches deep, not less than 14 inches wide, and not greater than about three feet deep.

The trench 114 is dug at an angle to the horizontal to provide for flow of water in the tile. Thus, cumbersome deep excavation is unnecessary. The trench may be dug manually and it is unnecessary for a workman to work in a deep, narrow trench.

On the outside surface of the wall 110, a waterproofing sealing membrane 116 is affixed to seal the wall. The membrane 116 is preferably constructed from a thick, rubberized material.

The membrane consists of a first portion 118 and a second portion 119. The first portion is a solid, thin membrane, which can be 48 inches long. The first portion extends from the second portion approximately 12 inches from an upper edge of the second portion. The second portion is thicker than the first portion, and can have a height of about twenty-four inches. The membrane is typically provided as rolls of 50 feet width to minimize the number of seams running between the membranes. The first portion 118 of the membrane is placed in the trench 114 to form a trough. A layer of gravel 120 is placed in the trough. The membrane is applied to the wall surface as follows. A light coating of a conventional dampproofing material (not shown) is sprayed onto the exposed wall surface. The membrane 116 is then placed onto the still wet dampproofing. The membrane is then fastened or buttoned to the wall at the top of the membrane via expandable concrete nails (not shown).

The membrane second portion 119 seals an upper surface of the wall 110 from surface water and minimizes installation problems of a liner separating from the wall. The system is used with walls with original pargeting. Digging and sealing any cracks in the pargeting may be performed down to the footer level. The backfill 126 may be filled with the material removed from the dig.

A drain tile 122 for draining water is then placed in the trough. The drain tile may take a variety of forms, for example, the drain tile may be corrugated perforated flexible pipe, plastic perforated pipe sections, etc. If pipe sections are used, the individual pipe sections or drain tiles 122 are placed in the trough and secured together by a suitable adhesive to form a pipe line.

After the drain tile 122 is placed in the trough, the trough is filled with additional gravel 120 to cover the tile. The gravel is preferably a washed river bed gravel size #57. The gravel size is large enough that it does not clog the openings in the drain tile. The gravel protects the tile from dirt and allows water to flow therethrough to the tile. The gravel 120 may be covered by a perforated plastic sheet 124 which can have 18 holes per square foot, and the trench may be back filled with a backfill 126 of earth. Because of the perforated plastic sheet and gravel, dirt is not readily able to penetrate and clog the drain tile.

A second, inside trench 128 is formed inside of the wall 110 next to the footer 112. A gravel bed 130 is laid and drain tile 132 is placed in the inside trench 128. These tiles, if individual pipe sections, are secured together by a suitable adhesive to form a pipe line. The respective pipe lines formed by the drain tiles 122 and 132 are inclined to the horizontal to provide for free flow of water through the lines.

The drain tiles 132 are also covered with gravel 130. The gravel 130 fills the trench 128 and forms a layer on a portion 134 of a top surface 136 of the footer 112 which is located inside the foundation wall 110. The top layer of the gravel can then be covered with cement forming a basement floor or base 140.

A liner 142 is mounted between the foundation wall 110 and adjacent the end of the basement floor or base 140. The liner 142 extends from the top surface of the footer 112 to slightly above the top surface of the base 140. The liner may have notches for conducting water which flows through weep holes in the bottom of the foundation wall 110 into the gravel. The liner may prevent seepage of water between the wall 110 and the base. The liner may also serve as a conduit for conducting water from the openings in the wall to the inside tiles.

Thus, the system shown in FIG. 4 seals the upper surface of wall 110 from surface water and allows water to enter next to the footer. This system eliminates slippage of a membrane separating from wall 110.

The drainage system of FIG. 4 operates as follows. Surface water outside the building flows into the first trench 114, the gravel 120, and through openings in the drain tile 122. This water flows through the drain tile into the storm sewer system. The tiles 122 located in the shallow trench outside the building provide for drainage of almost all surface water. Some water or moisture may form on the outside of the wall 110 and may flow down the wall. Membrane second portion 119 seals the upper portion of the wall and prevents the moisture from entering the wall. A small amount of water may build up from beneath the building base. This water flows into the drain tile 132 located beneath the base in the second, inside trench 128. This water flows through the drain tile and is pumped by a sump pump into the storm sewer system.

The advantages of this system are that it minimizes hydrostatic pressure underneath the concrete base 140 of the house, seals the upper outer surface of the wall 110 against surface water, and is designed for walls with original pargeting, and minimizes separation of the liner from the wall.

Figure 5:
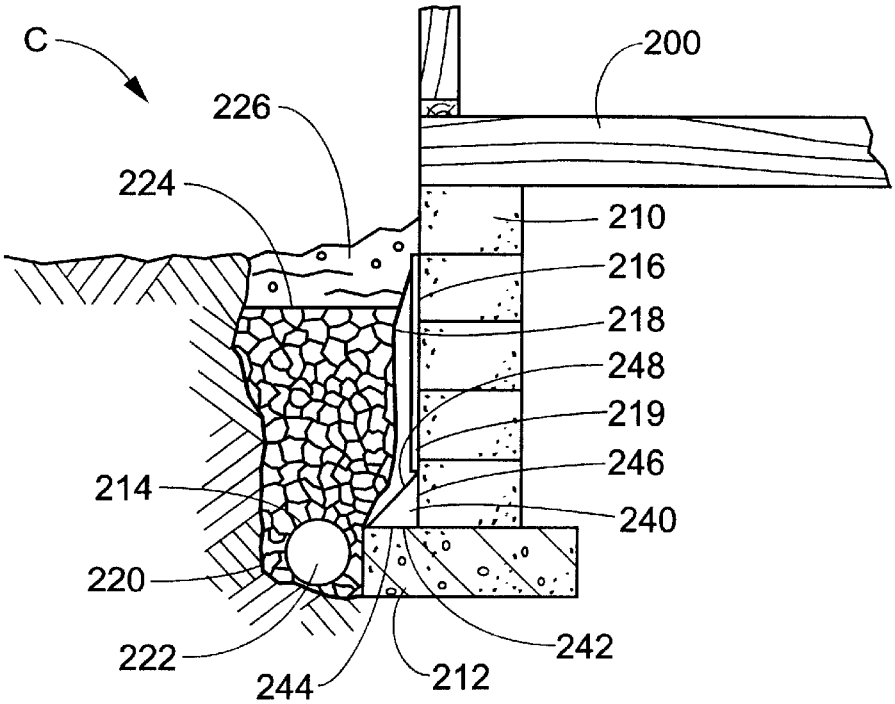
FIG. 5 is a schematic cross-sectional view of a portion of a building having a slab with a retrofit waterproofing system in accordance with a third preferred embodiment of the present invention; and, FIG. 6 is a front elevational view of a corner seal of the waterproofing system in accordance with the present invention.

A third embodiment is illustrated in FIG. 5. This waterproofing system C is designed as a retrofit for a building having no basement, such as a house on a slab foundation. It could also be used for a new building that has a slab foundation or crawlspace.

The waterproofing system C is used with a foundation wall 210, made of blocks, beneath a floor joist 200, supported on a footer 212. An outside trench 214 is excavated to a shallow depth beneath ground level next to an outside surface of the wall 210. Preferably, the trench is not less than 18 inches deep and, not less than 14 inches wide. The trench 214 is dug at an angle to horizontal to provide for flow of water. Thus, cumbersome deep excavation is unnecessary. The trench may be dug manually and it is unnecessary for workmen to work in a deep, narrow trench.

On the outside surface of the wall 210, a waterproofing sealing membrane 216 is affixed to seal the wall. The membrane 216 is preferably constructed from a thick, rubberized material.

Membrane consists of a first portion 218 and a second portion 219. First portion has a solid, thin membrane which can be about 48 inches long. The first portion extends from the second portion adjacent an upper edge of the second portion. The second portion is thicker than the first portion, can have a height of about 24 inches. The first portion 218 of the membrane is placed in the trench 214 to form a trough. A layer of gravel 220 is also placed in the trough.

The membrane is applied to the wall surface as follows. A light coating of a conventional dampproofing material, (not shown) is sprayed onto the exposed wall surface. Membrane second portion 219 is then placed on the still wet dampproofing. The membrane is then fastened or buttoned to the wall at the top of the membrane by conventional expandable concrete nails (not shown).

A drain tile 222 for draining water is then placed in the trough. The drain tile may take a variety of forms, for example it may be corrugated, perforated flexible pipe, plastic perforated pipe sections, etc. If pipe sections are used, the individual pipe sections or drain tiles 222 are placed in the trough and secured together by a suitable adhesive to form a pipeline.

After the drain tile 222 is placed in the trough, the trough if filled with additional gravel 220 to cover the tile. Gravel size is large enough so that it does not block any openings in the drain tile. Gravel 220 may be covered by a perforated plastic sheet 224 which can have about 18 holes per square foot, and the trench may be backfilled with fill dirt 226. Because of the perforated plastic sheet and gravel, dirt is not readily able to penetrate and clog the drain tile. Also, this arrangement blocks water from contact with the foundation wall or slab.

Referring still to FIG. 5, a filler or spacer block 240 is positioned on a top surface 242 or footer 212. The filler block is preferably made of styrofoam or a tar-based product that is about 6 inches wide and 6 inches high. The filler 240 can be triangular in shape so that it has first and second sides 224, 246 which are approximately normal to each other and a third side 248 which connects sides 244, 246. The filler block is placed on the top surface 242 of the footer 212 so that the first and second sides of the footer are adjacent to a seam formed between the top surface of the footer and the bottom surface of wall 210. Membrane 219 is adhered to wall 210 and extends along the length of the wall and abuts the top of the filler block. Membrane 218 runs along the length of wall 210 and is draped over the filler block and the footer 212. Thus, as water and moisture runs down the wall 210, it will be directed away from the footer by the filler block and the membrane 218 and toward the trench 220.

The membrane second portion 219 seals an outer surface of the wall 210 from surface water and minimizes installation problems of a liner separating from a wall. The membrane second portion 219 has an upper edge extending from adjacent the ground surface to a lower edge positioned adjacent an upper edge of the filler block 240. The second portion 219 can also have a width which covers the width of the wall 210. If desired, the membrane of the second portion can also have a width which covers the width of other walls of the building adjacent wall 210.

Thus, the system of FIG. 5 seals the outside wall 210 from surface water due to the one-piece construction of membrane 216. The system eliminates slippage and effectively seals the wall against any water intrusion. The footer is sealed and covered by the membrane 218. Thus, surface water outside. the building flows into the trench 214, the gravel 220, and through openings in the drain tile 222. This water flows through the drain tile into the storm sewer system. The tiles 222 are located in the shallow trench outside of the building provide for drainage of almost all surface water. However, some water or moisture may form on the outside of the wall 210 and may flow down the wall. Membrane first portion 218 seals the wall and prevents moisture from entering the wall. Further, second portion 219 provides additional sealing against the wall. The water may pour down to the filler block 240 which directs water away from the wall along membrane 218 toward the trench and drain tile. The system minimizes hydrostatic pressure adjacent the building, completely seals the outside surface of the wall 210 and minimizes any hydrostatic pressure that may accumulate outside of the slab.

Figure 6:
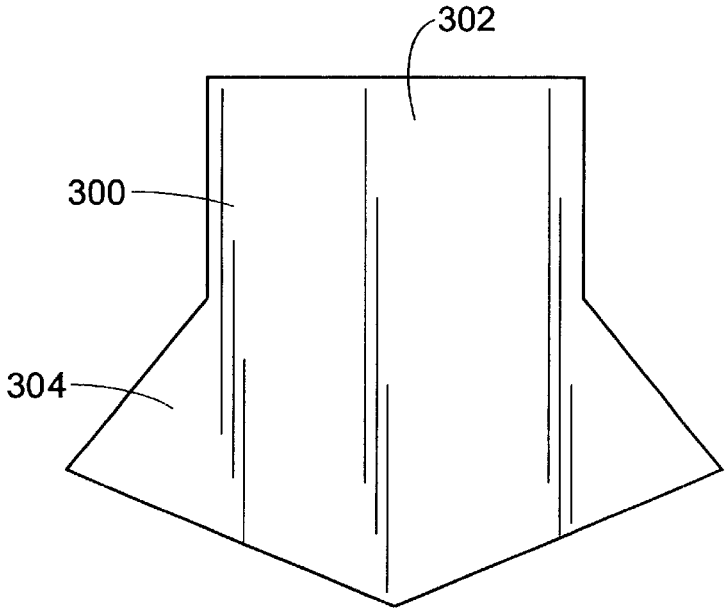

Referring now to FIG. 6, an exterior corner piece 300 may be installed prior to the membranes which seal the outside walls of each embodiment. The corner piece is installed at the footer of each exterior corner of the foundations or slabs to seal the particular corner. The exterior corner piece is draped over the corner formed by the footers and the walls of each foundation. Each membrane is cut or perforated so it can be separated or split to drape on the corner of the footer and wall sections. The corner piece 300 is used to seal the particular area that is left exposed by the cut portion of the membranes. Preferably, the exterior corner piece has an overall height of approximately 28 inches and an overall length of about 36 inches. The corner piece is preferably fabricated from a conventional 6 mil visqueen material. The first portion 302 has a height of about 12 inches and has a length of about 24 inches. Octagonal shaped portion 304 has a height of about 16 inches. The octagonal shape for portion 34 allows the corner piece to drape around the corner formed by the footer and wall sections. The corner pieces are designed to be installed prior to the membranes and the filler block to seal the corner area.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

Having thus described the preferred embodiments, the invention is now claimed to be:

1. A waterproofing system for draining water away from a building located in ground having a surface above which a portion of the building extends, the building having a footer and at least one wall extending vertically from said footer, said system comprising:

a first drain member located in a first trench provided in the ground outside the building, said first drain member extending adjacent at least a portion of said at least one wall; and a membrane comprised of a first portion secured to a second portion, said first portion and second portion having different thicknesses, said first portion forming a liner which lines at least a portion of said first trench to form a trough for capturing water flowing from the ground surface into said trench and for preventing water from flowing downwardly along said wall, said second portion being positioned adjacent an outer surface of said at least one wall along at least a portion of a height of said wall and extending toward said footer.

2. The waterproofing system of claim 1, wherein said first drain member comprises a pipe for receiving water captured in said trough and for conducting water away from said building.

3. The waterproofing system of claim 1, further comprising:

a base located within the building; and, a second drain member located in a second trench provided in the ground beneath said base adjacent a perimeter thereof, said second trench extending along at least a portion of said base and adjacent an inner surface of said at least one wall, wherein said second drain member comprises a pipe for receiving water captured in said second trench and for conducting water away from said building.

4. The waterproofing system of claim 3, wherein said first and second trenches comprise gravel filling which covers said first and second drain members.

5. The waterproofing system of claim 3, wherein said first and second drain members comprise perforated plastic tubes.

6. The waterproofing system of claim 3, further comprising a liner affixed to said inner surface of said at least one wall and extending to the top surface of said footer, wherein said second trench engages a portion of said liner.

7. The waterproofing system of claim 1, wherein said first portion of said membrane is thinner than said second portion, wherein said first portion extends from said second portion at a location below an upper edge of the second portion.

8. The waterproofing system of claim 1, wherein said membrane comprises a rubber material.

9. The waterproofing system of claim 1, further comprising a dampproofing coating positioned between said at least one wall and said membrane second portion.

10. The waterproofing system of claim 9, wherein said membrane second portion is fastened to said at least one wall adjacent a top end of said membrane second portion.

11. A waterproofing system for draining water away from a building located in ground having a surface above which a portion of the building extends, the building having a footer and at least one wall extending vertically from said footer, said system comprising:

a membrane assembly comprising a first membrane and a second membrane, said first membrane being secured to said second membrane at a location spaced from an end of said second membrane, said first portion forming a liner which lines at least a portion of a first trench located in the ground outside the building, wherein said liner forms a trough for capturing water flowing from the ground surface into said trench and for preventing water from flowing downwardly along said at least one wall, said second portion being positioned adjacent an outer surface of said at least one wall along at least a portion of a height of said wall and extending toward said footer.

12. The waterproofing system of claim 11, further comprising a first drain member located in said first trench provided in the ground, said first drain member extending adjacent at least a portion of said at least one wall.

13. The waterproofing system of claim 12, wherein said first drain member comprises a pipe for receiving water captured in said trough and for conducting water away from said building.

14. The waterproofing system of claim 12, further comprising:

a base located within the building; and, a second drain member located in a second trench provided in the ground beneath said base adjacent a perimeter thereof, said second trench extending along at least a portion of said base and adjacent an inner surface of said at least one wall, wherein said second drain member comprises a pipe for receiving water captured in said second trench and for conducting water away from said building.

15. The waterproofing system of claim 14, further comprising a third drain member located in a third trench provided in the ground beneath said base adjacent the perimeter thereof, said third trench extending along at least a portion of the base and adjacent said outer surface of said at least one wall, wherein said third drain member comprises a pipe for receiving water captured in said third trench and for conducting water away from said building.

16. The waterproofing system of claim 11, wherein said first portion of said membrane is thinner than said second portion, wherein said first portion extends from said second portion at a location below an upper edge of the second portion.

17. The waterproofing system of claim 16, further comprising a dampproofing coating positioned between said at least one wall and said membrane second portion.

18. The waterproofing system of claim 17, wherein said membrane second portion is fastened to said at least one wall.

19. The waterproofing system of claim 11, wherein said filler block includes an angled surface to drain water away from said seam.

20. The waterproofing system of claim 11, further comprising a filler block which is positioned on said footer wherein one of said first and second positions of said membrane is draped over said filler block.

21. The waterproofing system of claim 20, further comprising a corner seal member which is secured to a corner formed by said footer and said one wall such that said corner seal member drapes over and seals said corner, wherein said corner seal member is installed prior to said membrane and after said filler block.

22. A waterproofing system for draining water away from a building located in ground having a surface above which a portion of the building extends, the building having a footer and at least one wall extending vertically from said footer, said system comprising:

a membrane comprised of a first portion and a second portion of different thicknesses, said first portion being secured to said second portion, said first portion forming a liner which lines at least a portion of said first trench to form a trough for capturing water flowing from the ground surface into said trench and for preventing water from flowing downwardly along said at least one wall, said second portion being positioned adjacent an outside surface of said at least one wall along at least a portion of a height of said wall and extending from adjacent the ground surface toward said footer, wherein said membrane second portion is of a width sufficient to cover a width of said at least one wall; and, a filler block which is positioned adjacent a seam formed between a top surface of said footer and a bottom surface of said at least one wall.

23. The waterproofing system of claim 22, further comprising a first drain member located in said first trench provided in the ground, said first drain member extending adjacent at least a portion of said at least one wall.

24. A waterproofing system for draining water away from a building located in ground having a surface above which a portion of the building extends, the building having a footer and at least one wall extending vertically from said footer, said system comprising:

a first drain member located in a first trench provided in the ground outside the building, said first drain member extending adjacent at least a portion of said at least one wall, said footer being positioned substantially deeper in said ground than said first drain member;

a second drain member located in a second trench provided in the ground beneath a base located within the building and adjacent a perimeter thereof, said second trench extending adjacent at least a portion of said base and adjacent an inner surface of said at least one wall;

a membrane assembly comprised of a first membrane, a second, membrane and a third membrane, said first membrane being secured to said second membrane, said first membrane forming a liner which lines said first trench to form a trough for capturing water flowing from the ground surface into said trench and for preventing water from flowing downwardly along said at least one wall, said second membrane being affixed to an outer surface of said at least one wall along at least a portion of a height of said at least one wall and extending toward said footer;

said third membrane comprising a corner seal member which is secured to a corner formed by said footer and said one wall said third membrane is installed prior to said first and second membranes; and, a liner located adjacent to an inside surface of said at least one wall and extending to a top surface of said footer.

25. A method for waterproofing a building located in ground having a surface above which a portion of the building extends, the building having a footer and at least one wall extending vertically from said footer, the method comprising the steps of:

positioning a first drain member in a first trench in the ground outside the building, wherein said first drain member extends adjacent at least a portion of said at least one wall;

providing a membrane comprised of a first portion and a second portion, said first portion being secured to said second portion, said first portion being of a different thickness than said second portion;

lining at least a portion of the first trench with the first portion of the membrane to form a trough for capturing water flowing from the ground surface into said trench and for preventing water from flowing downwardly along said at least one wall; and, locating said second portion of the membrane adjacent to an outer surface of said at least one wall along at least a portion of a height of said wall in a manner so that the membrane second portion extends toward said footer.

26. The method of claim 25, further comprising the step of:

providing a second drain member located in a second trench in the ground beneath a base of the building adjacent a perimeter thereof, said second trench extending along at least a portion of said base and adjacent an inner surface of said at least one wall.

27. The method of claim 26, further comprising the step of:

providing a third drain member located in a third trench in the ground beneath said base adjacent the perimeter thereof, said third trench extending along at least a portion of the base and adjacent said outer surface of said at least one wall.

28. The method of claim 26, further comprising the step of affixing a liner to said inner surface of said at least one wall.

29. The method of claim 25, further comprising the step of positioning a filler block adjacent a seam formed between a top surface of said footer and a bottom surface of said at least one wall.

30. The method of claim 29 further comprising the step of draping one of said membrane first portion and said membrane second portion over said filler block.

31. The method of claim 29 further comprising the step of draping a corner piece over a portion of the filler block.

* * * * *